United States Patent [19]

Sedore

[11] 4,181,116

[45] Jan. 1, 1980

[54] STOVE

[76] Inventor: Ernest Sedore, Mount Albert, Ontario L0G 1M0, Canada

[21] Appl. No.: 907,230

[22] Filed: May 18, 1978

[51] Int. Cl.[2] ..... F24C 1/00; F23L 13/06

[52] U.S. Cl. ..... 126/60; 126/65; 126/285 A; 126/290

[58] Field of Search ..... 126/60, 61, 58, 64, 126/65, 66, 114, 118, 126, 285 R, 289, 290, 285 A; 110/163

[56] References Cited

U.S. PATENT DOCUMENTS

| | | | |
|---|---|---|---|
| 3,975 | 3/1845 | Atwood | 126/61 |
| 576,034 | 1/1897 | Cope | 126/60 |
| 955,007 | 4/1910 | Specht | 126/289 |
| 2,271,585 | 2/1942 | Fleming | 126/65 X |

FOREIGN PATENT DOCUMENTS

| | | | |
|---|---|---|---|
| 513859 | 2/1921 | France | 126/65 |
| 628484 | 10/1927 | France | 126/58 |
| 10591 | 11/1923 | Netherlands | 126/65 |

*Primary Examiner*—Samuel Scott
*Assistant Examiner*—Lee E. Barrett
*Attorney, Agent, or Firm*—Robert F. Delbridge; Arne I. Fors

[57] ABSTRACT

A wood-burning stove has a vertically corrugated surrounding wall, the vertical corrugations having an outer side in direct contact with the atmosphere and an inner side directly contactable by the wood fuel. The corrugated wall has air inlets which can be controlled by adjustable dampers.

9 Claims, 5 Drawing Figures

FIG.1.
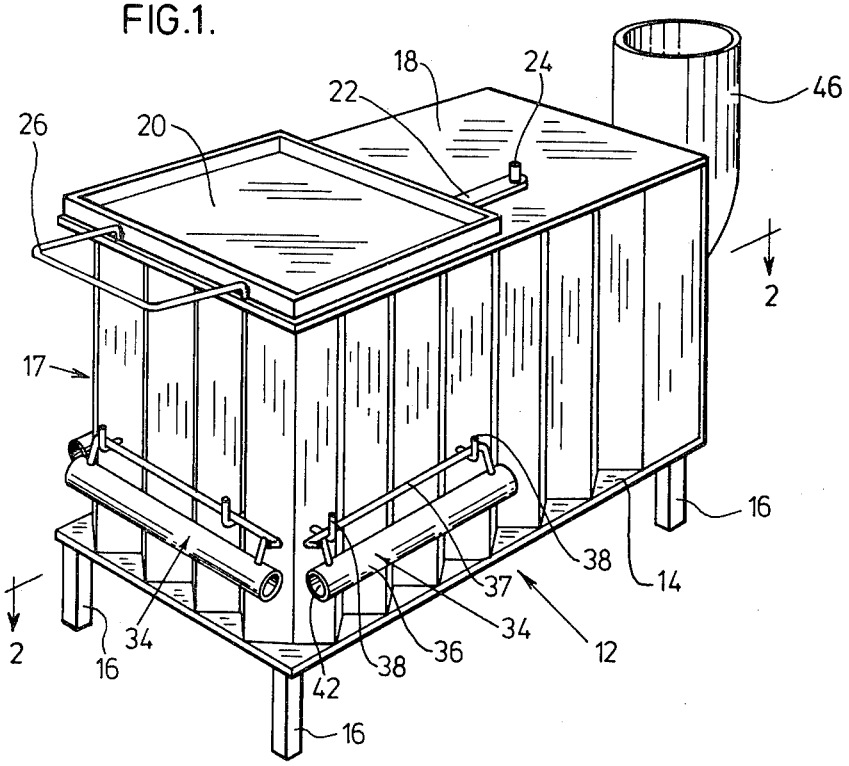
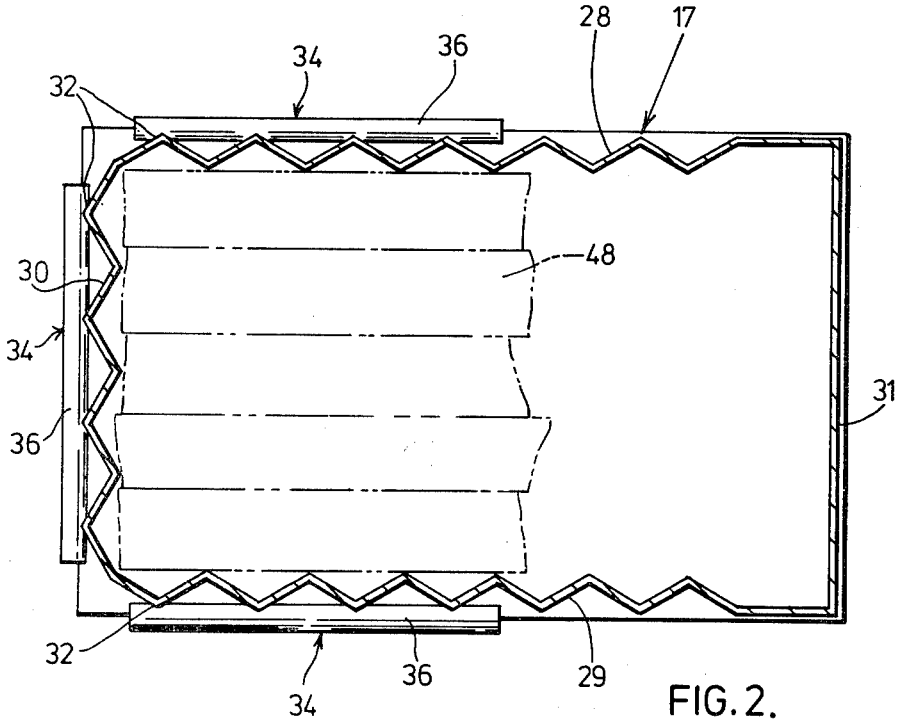
FIG. 2.

STOVE

This invention relates to stoves which are especially useful for burning wood.

Many different types of wood burning stoves are known. The more inexpensive stoves are usually also inefficient so far as wood burning and heat radiation from the stove are concerned whereas, on the other hand, the more efficient stoves are usually more complex and expensive.

It is therefore an object of the present invention to provide a stove which operates to burn wood and radiate heat from the stove efficiently, and which at the same time is not complex and expensive.

According to the invention, a stove comprises a body for receiving wood fuel, the body having a surrounding wall at least part of the periphery of which has vertical corrugations, the vertical corrugations having an outer side in direct contact with the atmosphere and an inner side directly contactable by the wood fuel.

Since the vertically corrugated wall is in direct contact with the atmosphere and with the burning wood, heat is very efficiently transferred from the burning wood to the corrugated wall, and is also efficiently radiated from the corrugated wall to the atmosphere. Further, the corrugated wall is resistant to warping during temperature changes, since the wall can expand when the stove heats up and contract when the stove cools down in an accordian-like manner. In addition, the corrugated wall provides more area from which heat can be radiated than a planar wall of the same peripheral dimensions.

Air inlet means may be provided to supply combustion air from the atmosphere to the inner side of the corrugations and thereby to the vertical channels formed between the corrugations and adjacent wood in the stove. Thus, burning of the wood adjacent the corrugated wall takes place very efficiently. The flames of combustion may actually impinge on the corrugated wall, with resultant efficient transfer of heat to the atmosphere around the stove.

The air inlet means may comprise apertures in the outer crests of the corrugated wall, and damper means may be provided which engage the air inlet means and which are adjustable to vary the effective size of the air inlet means to thereby control the amount of air admitted into the stove.

The damper means may comprise an elongated hollow member slidably mounted on the corrugated wall, the elongated member having at least one opening to receive air from the atmosphere and having side openings cooperable with the apertures in the corrugated wall, the elongated member being slidable to vary the overlap of the side openings with the apertures and thereby vary air flow into the stove through the hollow member and the apertures in the corrugated wall. The elongated member may be open at one end, and alternatively or additionally may have further side openings for receiving air from the ambient atmosphere.

The corrugated wall may have horizontally spaced brackets on its exterior, with the elongated member being suspended from the brackets and being horizontally slidable relative thereto.

The surrounding wall may comprise a pair of opposed corrugated side wall with each side wall having air inlet apertures in the outward crests of the corrugations and respective adjustable damper means associated with the apertures of each side wall. The surrounding wall may also include a corrugated end wall extending between the opposed side walls, with the end wall having air inlet apertures in outer crests of the corrugations, and with adjustable damper means associated with the air inlet apertures of the end wall.

One embodiment of the present invention will now be described, by way of example, with reference to the accompanying drawings, of which:

FIG. 1 is a perspective view of a stove,

FIG. 2 is a sectional view along the line 2—2 of FIG. 1,

Figure 3:
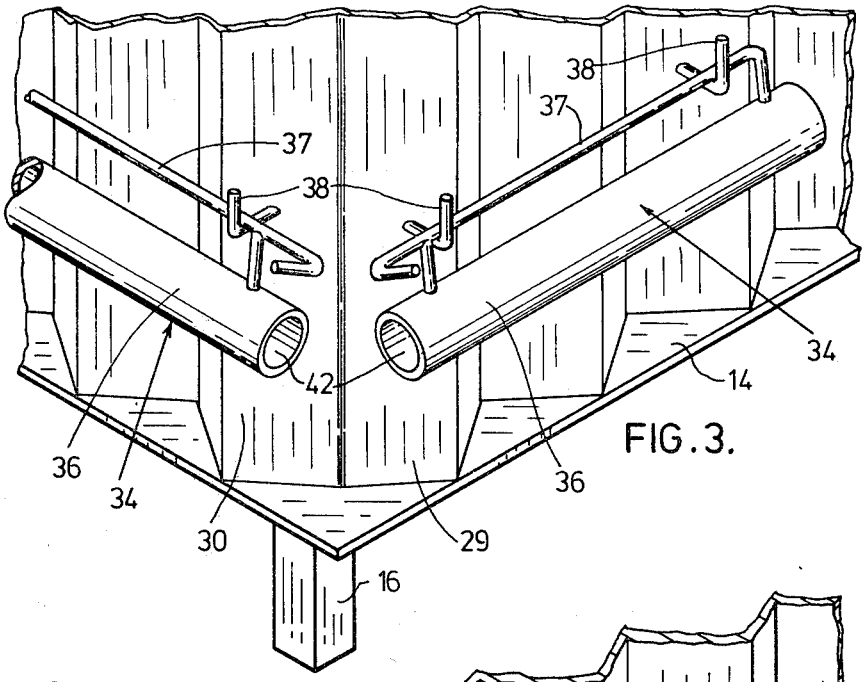
FIG. 3 is a perspective view on an enlarged scale of a damper means and adjacent corrugated wall.
Figure 4:
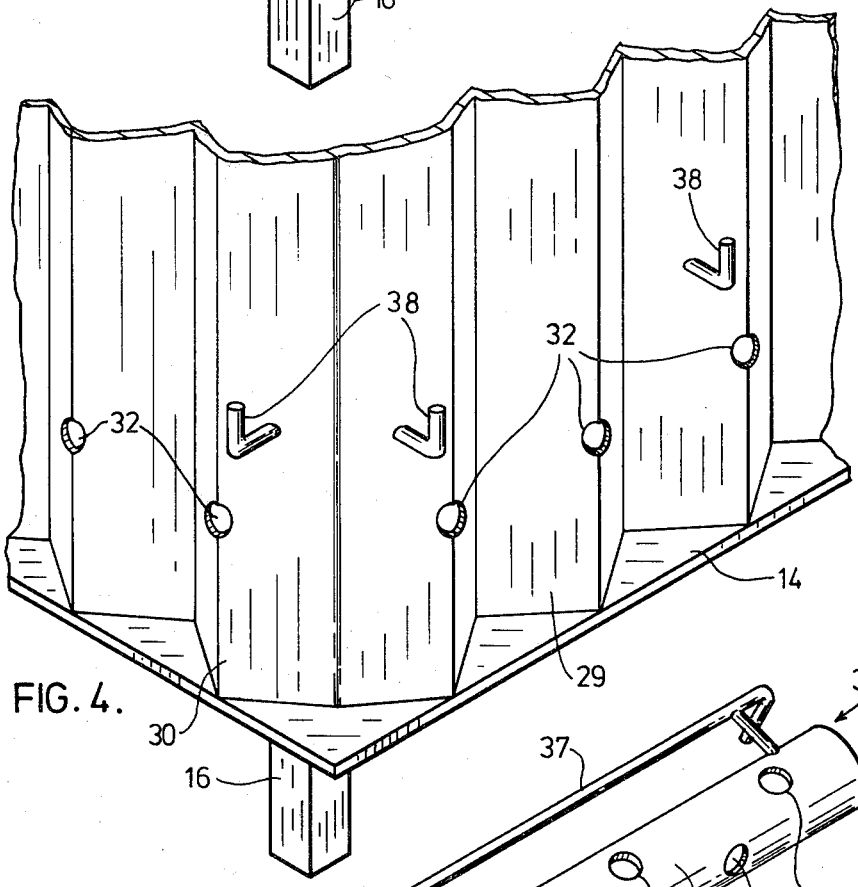
FIG. 4 is a similar view to FIG. 3 but with the damper tube removed.
Figure 5:
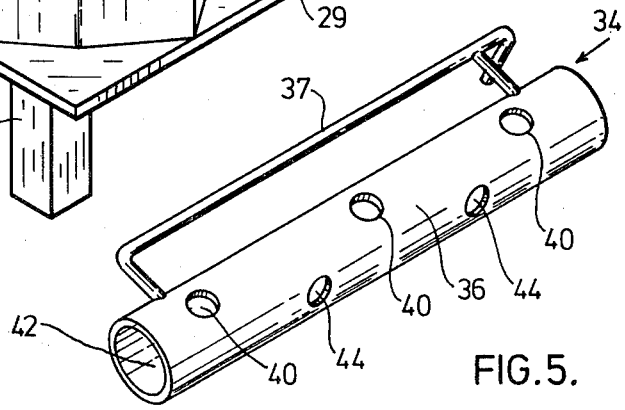
FIG. 5 is a perspective view of the rear and lower surfaces of the damper tube.

Referring to the drawings, a wood burning stove has a body 12 of sheet metal for receiving wood to be burned. The body 12 has a rectangular flat base 14 with legs 16 at each corner. A wall 17 surrounds and is welded to the base 14, and the top of the body 12 comprises a top portion 18 welded to the top of the wall 17 and extending over the rear half of the stove, with a cover 20 extending over the open front half of the top of the stove. The cover 20 has a rearwardly projecting retaining bar 22 loosely secured to a lug 24 on the stove top portion 18, so that the cover 20 can be moved sideways to open the top of the stove for inserting wood and removing ashes, the cover 20 being provided with a handle 26 for this purpose.

The surrounding wall 17 comprises opposed side walls 28, 29, and a front wall 30 and a rear wall 31 extending between the side walls 28, 29. The front wall 30 and all but the rearmost portions of side walls 28, 29 are vertically corrugated. The three outer crests of the corrugated front wall 30 and the three outer crests of the corrugated side walls 28, 29 nearest the front wall 30 are provided with air inlet apertures 32 a short distance above the base 14. The front wall 30 and side walls 28, 29 are further each provided with separate dampers 34 associated with respective air inlet apertures 32.

Each damper 34 comprises an elongated hollow member in the form of a tube 36 to which a slider bar 37 is secured. Two horizontally spaced brackets 38 are secured to the exterior of the adjacent wall, and the slider bar 37 rests on the brackets 38, thereby suspending the dampers 34 from the brackets 38 in a horizontally slidable manner. Each tube 36 has three openings 40 in its side wall which are spaced apart a distance equal to the distance between the air inlet apertures 32 in the crests of the corrugations of the adjacent wall. Each damper tube 36 is also open at its ends 42 and has two further openings 44 at positions which are axially intermediate and circumferentially spaced from the openings 40.

A stove pipe 46 extends from an upper part of the rear wall 32, that is to say from the end of the stove remote from the air inlet apertures 32, the dampers 34 and the cover 20.

In use of the stove, pieces of wood 48 (shown in dotted outline in FIG. 2) are loaded into the stove through the open part of the top, the cover 20 of course first having been moved to the open position. It can be seen from FIG. 2 that most of the wood 28 engages the inner crests of the corrugated walls 28, 29, 30. The stove is lit in the usual way with paper and small pieces of wood, also inserted through the open top of the stove, with the cover 20 then being closed.

At the same time, the dampers 34 are moved by horizontal sliding movement to positions in which the openings 40 in the damper tubes 36 are aligned with the respective apertures 32 in the outer crests of the corrugated walls. Combustion air then enters each damper tube 36 from the atmosphere through the open ends 42 and further openings 44 and passes into the stove through the openings 40 and apertures 32. Since the apertures 32 are at the outer crests of corrugations, the combustion air is able to flow upwardly inside the stove in the channels formed between the wood and the corrugations. Thus, a major part of the combustion of the wood 48 occurs adjacent to the walls 28, 29, 30, with the result that heat is efficiently transferred from the burning wood to the walls and radiated to the atmosphere.

After the stove has been lit, the rate of burning of the wood can be very easily controlled by adjusting the horizontal positions of the dampers 34 to vary the amount of overlap between the openings 40 and apertures 32, thereby controlling the amount of air entering the stove. The relative positions of the openings 40 and 44 in the damper tubes 36 are such that any sparks passing into the tubes 36 from the stove through the apertures 32 and openings 40 cannot pass out of the openings 44, thereby providing a safe damper arrangement.

Since the stove pipe 46 is at the rear end of the stove, remote from the air inlet air apertures 32 adjacent the front end, the proportion of heat lost up the stove pipe 46 is relatively small. The stove pipe 46 may be provided with a conventional damper arrangement to further limit heat loss.

The stove does not require a grate to provide combustion air to the centre of the stove. The burning of centrally located wood is not particularly efficient and, as mentioned earlier, the wood is burned from the outer parts inwardly, with the heat of combustion thus being as near to the corrugated stove walls as possible. The stove can be maintained in operation for a considerable time by feeding more wood into the stove periodically, and it has been found that wet wood can be burned efficiently. Ashes can be removed from the stove through the open top when the stove is not in operation.

In specific examples of stoves in accordance with the invention, the body 12 may be from 26 to 40 inches long, 13 to 20 inches wide, with a depth of 20 inches and with the air inlet apertures 32 being 4 inches above the base 14. The corrugations may be of such a size that there is about 4½ inches between adjacent crests. With narrower stoves, the damper 34 on the front wall 30 may be omitted and, with the smaller stoves, only one damper 34 may be provided. The corrugated walls may be of sheet metal with a thickness of about one-eighth of an inch, it having been found that sheet metal of such a thickness provides sufficient heat radiation and does not wear away to any significant extent.

Additionally or alternatively, air inlet apertures may be provided in the base 14 adjacent the inner side of the corrugated walls for supplying air to the vertical channels between the wood and the corrugations.

The described embodiment clearly demonstrates the inexpensive nature and efficiency of the present invention. Other embodiments will be apparent to a person skilled in the art, the scope of the invention being defined in the following claims.

What I claim as new and desire to protect by Letters Patent of the United States is:

1. A stove comprising a body for receiving wood fuel, said body having a surrounding wall at least a substantial part of the periphery of which has vertical corrugations, said vertical corrugations having an outer side in direct contact with the atmosphere and an inner side directly contactable by the wood fuel, and air inlet means comprising apertures in the outer crests of the corrugations for supplying air from the atmosphere to the inner side of the corrugations and thereby to vertical channels formed between the corrugations and adjacent wood in the stove.

2. A stove according to claim 1 including damper means engaging said apertures and being adjustable to vary the effective size of said apertures.

3. A stove according to claim 2 wherein said damper means includes an elongated hollow member slidably mounted on said wall, said hollow member being open to receive air from the ambient atmosphere and having side openings cooperable with said apertures in said outer corrugation crests, and said hollow member being slidable to vary the overlap of said openings and said apertures and thereby vary air flow into the stove through said hollow member and said apertures.

4. A stove according to claim 3 wherein the hollow member is open at one end for receiving air from the ambient atmosphere.

5. A stove according to claim 3 wherein the hollow member has further side openings for receiving air from the ambient atmosphere.

6. A stove according to claim 5 wherein said wall has horizontally spaced brackets on its exterior, and said hollow damper member is suspended from said side brackets and is horizontally slidable relative thereto.

7. A stove according to claim 2 wherein said surrounding wall includes a pair of opposed corrugated side walls, each side wall having air inlet apertures in outer crests, and separate adjustable damper means being associated with each side wall for varying the effective size of the respective apertures.

8. A stove according to claim 7 wherein said surrounding wall also includes a front corrugated wall extending between said side walls, said front wall also having air inlet apertures in outer corrugation crests, and a further adjustable damper means associated with said front wall to vary the effective size of the apertures therein.

9. A stove according to claim 7 wherein said damper means and associated apertures in said side walls are located adjacent a front end of the stove, and a stove pipe extends from a position adjacent the rear end of the stove.

* * * * *